United States Patent [19]

Guth et al.

[11] Patent Number: 4,844,710

[45] Date of Patent: Jul. 4, 1989

[54] AQUEOUS TEXTILE ASSISTANT OF HIGH STORAGE STABILITY AND HARD WATER RESISTANCE

[75] Inventors: Christian Guth, Birsfelden; Jörg Haase, Riehen, both of Switzerland; Albert Stehlin, Rosenau, France

[73] Assignee: Ciba-Geigy Corporation, Ardsley, N.Y.

[21] Appl. No.: 126,979

[22] Filed: Nov. 30, 1987

[30] Foreign Application Priority Data

Dec. 8, 1986 [CH] Switzerland ..... 4886/86
Jul. 30, 1987 [CH] Switzerland ..... 2914/87

[51] Int. Cl.[4] ..... D06M 1/02

[52] U.S. Cl. ..... 8/127.1; 8/584; 8/532; 8/534; 8/533; 8/531

[58] Field of Search ..... 8/127.1, 477, 543, 580, 8/584, 532, 533, 534, 531

[56] References Cited

U.S. PATENT DOCUMENTS 3,433,574 3/1969 Durch et al. ..... 8/580
4,579,559 4/1986 Canela ..... 8/543

*Primary Examiner*—Prince E. Willis
*Assistant Examiner*—John F. McNally
*Attorney, Agent, or Firm*—Wenderoth, Lind & Ponack

[57] ABSTRACT

Aqueous textile assistants of high storage stability and hard water resistance comprising at least (a) a partial phosphoric ester, (b) a nonionic surfactant, (c) an anionic surfactant and (d) an alkali metal hydroxide. They can be used for wetting and deaerating fibre materials.

12 Claims, No Drawings

AQUEOUS TEXTILE ASSISTANT OF HIGH STORAGE STABILITY AND HARD WATER RESISTANCE

The present invention relates to a novel textile assistant and to the use thereof for wetting and deaerating fibre materials.

It is known, for example from U.S. Pat. No. 3,433,574 and U.S. Pat. No. 4,579,559, to use assistants, in particular wetting agents, in the treatment of textiles to improve the treatment in alkaline liquors. The assistants proposed for application, however, are not sufficiently stable to storage and in hard water lead to precipitations.

There has now been found a textile assistant which does not have these disadvantages.

The novel aqueous textile assistant of high storage stability and hard water resistance contains at least (a) a partial phosphoric ester, (b) a nonionic surfactant, (c) an anionic surfactant and (d) an alkali metal hydroxide.

A suitable alkali metal hydroxide component is potassium hydroxide and preferably sodium hydroxide.

Components (b) and (c) can be present as individual compounds or as mixtures.

The partial phosphoric ester for use as component (a) is to be understood as meaning an alkyl phosphate, which can be prepared by adding 1 mole of phosphorous(V) oxide to 3 moles of fatty alcohol with sufficient cooling to produce 1 mole of a dialkyl phosphate and 1 mole of a monoalkyl phosphate. This mixture is trivially also referred to as a 1½ ester.

Suitable fatty alcohols are those having 1 to 10, preferably 8 to 10, and in particular 8, carbon atoms. Particular preference is given to 2-ethylhexanol.

Suitable nonionic surfactants of component (b) are nonionic alkylene oxide addition products of 1 to 100 moles of alkylene oxide, for example ethylene oxide and/or propylene oxide, on 1 mole of an aliphatic monoalcohol having at least 4 carbon atoms, a 3- to 6-hydric aliphatic alcohol, an unsubstituted or alkyl- or phenyl-substituted phenol, or a fatty acid having 8 to 22 carbon atoms. Preferred monoalcohols have 8 to 22 carbon atoms. The preferred addition products are preferably partially terminally blocked with alkyl groups having preferably 1 to 5 carbon atoms.

The preparation of such terminally blocked surfactants is carried out in a manner known per se, for example by reacting the alkylene oxide addition products with thionyl chloride and subsequently reacting the resulting chlorine compound with a fatty alcohol or short-chain alcohol.

The aliphatic monoalcohols are for example water-insoluble monoalcohols having preferably 8 to 22 carbon atoms. These alcohols can be saturated or unsaturated and branched or straight-chain and can be used solo or mixed. It is possible to react with the alkylene oxide natural alcohols, for example myristyl alcohol, cetyl alcohol, stearyl alcohol or oleyl alcohol, or synthetic alcohols such as, in particular 2-ethylhexanol and also trimethylhexanol, trimethylnonyl alcohol, hexadecyl alcohol, or linear primary alcohols having average carbon atom numbers of (8–10), (10–14), (12), (16), (18) or (20–22).

Further aliphatic alcohols which can be reacted with the alkylene oxide are 3- to 6-hydric alkanols. They contain 3 to 6 carbon atoms and are in particular glycerol, trimethylolpropane, erythritol, mannitol, pentaerythritol and sorbitol. The 3- to 6-hydric alcohols are preferably reacted with propylene oxide or ethylene oxide or mixtures of these alkylene oxides.

Examples of suitable substituted and unsubstituted phenols are phenol, o-phenylphenol and alkylphenols whose alkyl radical has 1 to 16, preferably 4 to 12, carbon atoms. Examples of these alkylphenols are p-cresol, butylphenol, tributylphenol, octylphenol and in particular nonylphenol.

The fatty acids preferably have 8 to 12 carbon atoms and can be saturated or unsaturated, for example capric, lauric, myristic, palmitic or stearic acid on the one hand or decenoic, dodecenoic, tetradecenoic, hexadecenoic, oleic, linoleic, linolenic, or preferably ricinoleic acid.

Examples of nonionic surfactants are:

addition products of preferably 1 to 30 moles of alkylene oxides, in particular ethylene oxide, it being possible for individual ethylene oxide units to be replaced by substituted epoxides, such as styrene oxide and/or propylene oxide, on higher unsaturated or saturated fatty alcohols, fatty acids, fatty amines or fatty amides having 8 to 22 carbon atoms or on phenylphenol or alkylphenols whose alkyl radicals have at least 4 carbon atoms;

condensation products of alkylene oxide, in particular ethylene oxide and/or propylene oxide;

reaction products of a fatty acid which has 8 to 22 carbon atoms and a primary or secondary amine which has at least one hydroxy(lower alkyl) or (lower alkoxy)(lower alkyl) group, or alkylene oxide addition products of these hydroxyalkyl-containing reaction products, the reaction being carried out in such a way that the molecular mixing ratio between hydroxyalkylamine and fatty acid can be 1:1 and greater than 1, for example 1.1:1 to 2:1, addition products of propylene oxide on a tri- to hexahydric aliphatic alcohol of 3 to 6 carbon atoms, for example glycerol or pentaerythritol, the polypropylene oxide adducts having an average molecular weight of 250 to 1800, preferably 400 to 900, and esters of polyalcohols, in particular mono- or diglycerides of fatty acids having 12 to 18 carbon atoms, for example monoglycerides of lauric, stearic or oleic acid.

Highly suitable nonionic surfactants are addition products of 2 to 15 moles of ethylene oxide on 1 mole of fatty alcohol or fatty acid having in each case 8 to 22 carbon atoms or on 1 mole of alkylphenol having a total of 4 to 12 carbon atoms in the alkyl moiety or fatty acid dialkanolamides having 8 to 22 carbon atoms in the fatty acid radical.

Preferred nonionic surfactants have a low cloud point, i.e. a cloud point which is no longer determinable in water.

The anionic surfactants of component (c) are preferably derivatives of alkylene oxide adducts, for example acid addition products of alkylene oxides, and in particular ethylene oxide and/or propylene oxide or even styrene oxide, containing ether groups or preferably ester groups of inorganic or organic acids, on organic hydroxyl, carboxyl, amino and/or amido compounds having aliphatic hydrocarbon radicals of in total at least 4 carbon atoms, or mixtures thereof. These acid ethers or esters can be present as free acids or as salts, for example alkali metal, alkali earth metal, ammonium or amine salts.

The preparation of these anionic surfactants is effected by known methods by for example adding onto the organic compounds mentioned at least 1 mole, preferably more than 1 mole, for example 2 to 60 moles, of ethylene oxide or propylene oxide or, alternatingly in any desired order, ethylene oxide or propylene oxide and subsequently etherifying or esterifying the addition products and if desired converting the ethers or esters into their salts. Suitable base materials are higher fatty alcohols, i.e. alkanols or alkenols having in each case 8 to 22 carbon atoms, dihydric to hexahydric aliphatic alcohols of 2 to 9 carbon atoms, alicyclic alcohols, phenylphenols, benzylphenols, alkylphenols having one or more alkyl substituents which has, or which together have, at least 4 carbon atoms, fatty acids having 8 to 22 carbon atoms, amines which have aliphatic and/or cycloaliphatic hydrocarbon radicals of at least 8 carbon atoms, in particular such fatty amines, hydroxyalkylamines, hydroxyalkylamides and aminoalkyl esters of fatty acids or dicarboxylic acids and higher-alkylated aryloxycarboxylic acids as have such radicals.

Examples of suitable anionic surfactants are:

sulphated aliphatic alcohols whose alkyl chain has 8 to 18 carbon atoms, for example sulphated lauryl alcohol;

sulphated unsaturated fatty acids or lower alkyl esters thereof having 8 to 20 carbon atoms in the fatty radical, for example ricinoleic acid and oils containing such fatty acids, for example castor oil;

alkanesulphonates whose alkyl chain contains 8 to 20 carbon atoms, for example dodecylsulphonate;

alkylarylsulphonates having a straight-chain or branched alkyl chain having at least 6 carbon atoms, for example dodecylbenzenesulphonates or 3,7-diisobutylnaphthalenesulphonates;

sulphonates of polycarboxylic esters, for example dioctyl sulphosuccinates or sulphosuccinamides;

the soap alkali metal, ammonium or amine salts of fatty acids having 10 to 20 carbon atoms, for example rozin salts;

such addition products of 1 to 60 ethylene oxide and/or propylene oxide on fatty amines, fatty acids or fatty alcohols having in each case 8 to 22 carbon atoms, on alkylphenols having 4 to 16 carbon atoms in the alkyl chain or on trihydric to hexahydric alkanols having 3 to 6 carbon atoms as have been converted into an acid ester with an organic dicarboxylic acid, for example maleic acid, or sulphosuccinic acid, but preferably with an inorganic polybasic acid such as orthophosphoric acid or sulphuric acid.

Highly suitable anionic surfactants of component (c) are acid esters, or salts thereof, of a polyadduct of 2 to 30 moles of ethylene oxide on 1 mole of fatty alcohol having 8 to 22 carbon atoms or on 1 mole of a phenol which has at least one benzyl group, one phenyl group or preferably one alkyl group having at least 4 carbon atoms, e.g. benzylphenol, dibenzylphenol, dibenzyl-(nonyl)-phenol, o-phenylphenol, butylphenol, tributylphenol, octylphenol, nonylphenol, dodecylphenol or pentadecylphenol.

Particularly preferred components (c) conform to the formula $$(1)\ R—O—(CH_2CH_2O)_m—X,$$

in which R is alkyl or alkenyl having 8 to 22 carbon atoms, alkylphenyl having 4 to 16 carbon atoms in the alkyl moiety or o-phenylphenyl, X is the acid radical of an inorganic oxygen-containing acid, for example phosphoric acid or preferably sulphuric acid, or, alternatively, the radical of an organic acid, and m is 2 to 30, preferably 2 to 15. The alkyl radical in alkylphenyl is preferably in the para-position. The alkyl radicals in alkylphenyl can be butyl, hexyl, n-octyl, n-nonyl, p-tert.-octyl, p-iso-nonyl, decyl or dodecyl. Preference is given to alkyl radicals having 8 to 12 carbon atoms, in particular octyl and nonyl The fatty alcohols for preparing the anionic surfactants of formula (1) are for example those having 8 to 22, in particular 8 to 18, carbon atoms, such as octyl, decyl, lauryl, tridecyl, myristyl, cetyl, stearyl, oleyl, arachidyl or behenyl alcohol.

The acid radical X is derived for example from low molecular weight dicarboxylic acids, e.g. maleic acid, malonic acid, succinic acid or sulphosuccinic acid, and is connected to the ethylene oxide moiety of the molecule via an ester bridge. In particular, however, X is derived from inorganic polybasic acids, such as orthophosphoric acid and in particular sulphuric acid. The acid radical X can be present in salt form, for example as an alkali metal, ammonium or amine salt. Examples of such salts are lithium, sodium, potassium, ammonium, trimethylamine, ethanolamine, diethanolamine and triethanolamine salts.

Further, particularly preferred components (c) conform to the formula $$(2)\ R—O—(CH_2CH_2O)_m—X_1$$

in which R is alkyl or alkenyl having 8 to 22 carbon atoms, $X_1$ is a carboxy-$C_1$–$C_3$-alkyl, such as carboxymethyl, carboxyethyl or carboxypropyl, and m is 2 to 30, preferably 2 to 5.

The components (c) of the formula (2) are prepared in a manner known per se, for example by reacting a fatty alcohol ethoxylate with a halogenated lower carboxylic acid ($C_2$–$C_4$) in the presence of, for example, sodium hydroxide solution. They can also be used in the form of their salts, for example as alkali metal, ammonium or amine salt. Examples of such salts are lithium, sodium, potassium, ammonium, trimethylamine, ethanolamine, diethanolamine and triethanolamine salts. The sodium salts are preferred.

The novel assistant mixtures can be prepared by simply stirring of the said components (a), (b), (c) and (d) with or without cooling. In this process, components (a) and (c) can already be present in the form of their salts. The preparation is preferably effected by introducing components (a) initially, adding components (b) and (c) with stirring, adding to the resulting mixture, with cooling, the aqueous solution of component (d), and if desired additionally adding deionized water.

The textile assistant according to the invention contains with advantage, based on the entire mixture, 5 to 45% by weight of component (a),
3 to 27% by weight of component (b),
0.8 to 7% by weight of component (c),
1.2 to 19% by weight of component (d) and
2 to 90% by weight of deionized water.

The novel textile assistants are aqueous formulations of high storage stability and hard water resistance which are suitable in particular for wetting and deaerating fibre materials.

The present invention accordingly also provides a process for wetting and deaerating fibre materials. The process comprises treating these materials in an aqueous medium in the presence of a textile assistant according to the invention.

The amounts in which the textile assistant according to the invention is added to the treatment liquors range from 0.1 to 20, preferably from 0.5 to 10 g per liter of treatment liquor. This liquor can additionally contain further additives, for example desizing agents, dyes, fluorescent brightening agents, synthetic resins and alkalis such as sodium hydroxide.

Possible fibre materials are: cellulose, in particular pretreated natural cellulose, for example hemp, linen, jute, viscose staple, viscose filament, acetate rayon, natural cellulose fibre and in particular raw cotton, wool, polyamide, polyacrylonitrile or polyester fibre materials and also fibre blends, for example those of polyacrylonitrile/cotton or polyester/cotton.

The fibre material to be treated can be present in a very wide variety of stages of processing, for instance the cellulose-containing for example as loose material, yarn, woven fabric or knitted fabric. The fibre materials are thus in general always textile fibre materials which are produced from pure textile cellulose fibres or from mixtures of textile cellulose fibres with textile synthetic fibres. The fibre material can be treated continuously or batchwise in aqueous liquor.

The aqueous treatment liquors can be applied in a known manner to the fibre materials, advantageously by impregnating on a pad-mangle, the liquor pick-up being about 50 to 120% by weight. The padding method is used in particular in the pad-steam process, the pad-thermofix process and pad-batch processes.

The impregnating can be effected at 20° to 60° C., but preferably at room temperature. After impregnating and squeezing off, the cellulose material if appropriate after intermediate drying, is subjected to a heat treatment, for example at temperatures of 95° to 210° C. For example, the heat treatment, preceded by intermediate drying of the material at 80° to 120° C., can be carried out by thermofixing at a temperature of 120° to 210° C., preferably 140° to 180° C. Preferably, the heat treatment is carried out directly, i.e. without intermediate drying, by steaming at 95° to 120° C., preferably 100° to 160° C. Depending on the nature of the heat development and the temperature range, the heat treatment can take from 30 seconds to 10 minutes. In the pad-batch process, the impregnated material is rolled up without drying and subsequently stored at room temperature from 1 to 24 hours, if desired wrapped in a plastics film.

However, the treatment of the fibre materials can also be carried out in so-called long liquors at a liquor ratio of, for example, 3:1 to 100:1, preferably 8:1 to 25:1, and at 20 to 100, preferably 80° to 98° C. in the course of about ¼ to 3 hours under normal conditions, i.e. under atmospheric pressure, in customary apparatus, for example a jigger or a winch deck. However, if desired the treatment can also be carried out at up to 150° C., preferably 105° to 140° C., under superatmospheric pressure in so-called high-temperature apparatus (HT apparatus).

Subsequently, the fibre materials, if required by the process, are thoroughly rinsed with hot water at about 90° to 98° C. and then with warm and finally with cold water, if necessary neutralized and then preferably dewatered and dried at elevated temperatures.

The most significant advantages of the textile assistants according to the invention, in addition to their excellent wetting activity, are their good hard water resistance and low-foam properties in application.

In the Examples which follow, percentages are always by weight.

EXAMPLE 1: PREPARATION OF A COMPONENT (A)

A reaction flask is charged with 781.0 g of 2-ethylhexanol, and 264.0 g of $P_2O_5$ are added with stirring at a temperature of 25°–30° C. in the course of 120 minutes. The resulting slightly cloudy reaction mass is subsequently stirred for a further 3 hours. The result is a product which is

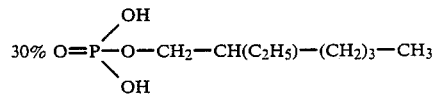

30% $O{=}P(OH)_2{-}O{-}CH_2{-}CH(C_2H_5){-}(CH_2)_3{-}CH_3$ and

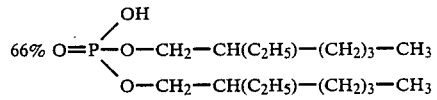

66% $O{=}P(OH){-}O{-}CH_2{-}CH(C_2H_5){-}(CH_2)_3{-}CH_3$
$\qquad\qquad\qquad\qquad\qquad\qquad\quad O{-}CH_2{-}CH(C_2H_5){-}(CH_2)_3{-}CH_3$

EXAMPLE 2: PREPARATION OF A TEXTILE ASSISTANT ACCORDING TO THE INVENTION

A vessel is charged with 312.5 g of component (a) prepared as described in Example 1, followed in succession with stirring by 225 g of a partially terminally methyl-blocked addition product of 5 mol of ethylene oxide and 8 mol of propylene oxide on 1 mol of a $C_9$–$C_{11}$-alkanol as component (b) and 50 g of the sodium salt of the terminally carboxymethyl-blocked addition product of 2.5 mol of ethylene oxide on 1 mol of lauryl alcohol as component (c). After the addition is complete, the mixture is stirred for a few more minutes and then diluted with cooling and stirring with 187.5 g of 30% sodium hydroxide solution and then 225 g of deionized water. The resulting mixture has a pH of 8. To obtain equivalent textile assistants the procedure described above is repeated, except that the compounds listed below are used as components (a), (b) and (c) in the quantities reported in Table I.

Component (a)

(AA) reaction product of 1 mol $P_2O_5$ and 3 mol 2-ethylhexanol consisting of 38% monoester and 62% diester;
(AB) reaction product of 1 mol $P_2O_5$ and 3 mol hexanol;
(AC) reaction product of 1 mol $P_2O_5$ and 3 mol decyl alcohol (e.g. Victawet® 58-B) and
(AD) reaction product of 1 mol $P_2O_5$ and 3 mol of a technical $C_9$–$C_{11}$-alcanol.

Component (b)

(BA) modified polyethoxylated straight-chain alcohol (e.g. Ukanil® 190);
(BB) adduct of 1 mol nonyl phenol and 2 mol ethylene oxide;
(BC) adduct of 1 mol of a technical $C_9$–$C_{11}$-alkanol, 5 mol ethylene oxide and 4 mol propylene oxide (e.g. Marlox® FK 4);
(BD) blockpolymer of 30 mol propyleneglycol and 4.5 mol ethylene oxide (e.g. Pluronic® C61) and
(BE) propoxylated glycerol having a molecular weight of 4200.

Component (c)

(CA) reaction product of 1 mol lauryl alcohol, 2.5 mol ethylene oxide and 1 mol chloroacetic acid (e.g. Akypo ® RLM 25);

(CB) reaction product of 1 mol lauryl alcohol, 5 mol ethylene oxide and 1 mol chloroacetic acid (e.g. Sandopan ® DTC);

(CC) sodium lauryltriglycolethersulfate;

(CD) phosphoric acid ester of the reacton product of 1 mol nonylphenol and 9.5 mol ethylene oxide;

(CE) disodium laurylsulfosuccinamate;

(CF) reaction product of 1 mol nonylphenol, 7 mol ethylene oxide and 1 mol chloroacetic acid and (CG) ammonium salt of the acid sulfonic acid ester of the adduct of 1 mol nonylphenol and 2 mol ethylene oxide.

TABLE I

| component | Textile assistant 1 | 2 | 3 | 4 | 5 | 6 | 7 | 8 | 9 |
|---|---|---|---|---|---|---|---|---|---|
| AA | 29 | 29 | 29 | 29 | | | | 29 | 29 |
| AB | | | | | 29 | | | | |
| AC | | | | | | 29 | | | |
| AD | | | | | | | 29 | | |
| BA | 21 | 21 | | | | 21 | | | |
| BB | | | 21 | | | | 21 | | 21 |
| BC | | | | 21 | | | | | |
| BD | | | | | 21 | | | | |
| BE | | | | | | | | 21 | |
| CA | 5 | | | | | | | | |
| CB | | 5 | | | | 5 | | | |
| CC | | | 5 | | 5 | | | | |
| CD | | | | | | | 5 | | |
| CE | | | | | | | | 10 | |
| CF | | | | 5 | | | | | |
| CG | | | | | | | | | 10 |
| sodium hydroxide (30%) | 17,5 | 17,5 | 17,5 | 17,5 | 19,0 | 11,0 | 13,0 | 17,5 | 17,5 |
| water | 27,5 | 27,5 | 27,5 | 27,5 | 26,0 | 34,0 | 32,0 | 22,5 | 22,5 |
| | 100 | 100 | 100 | 100 | 100 | 100 | 100 | 100 | 100 |

EXAMPLE 3

A grey-state, starch-sized cotton fabric is impregnated with a desizing liquor which contains per liter 2 g of the textile assistant prepared as described in Example 2, 4 g of a stabilized bacterial amylase and 3 g of NaCl and has a calcium water hardness of 10° of German hardness and is squeezed off to a liquor pick-up of 100%. The impregnated fabric is rolled up, packed air-tight with a plastic film and stored at room temperature (15°–25° C.) for 24 hours. The fabric is subsequently washed first with hot water (90°–98° C.) containing 4 g/l of solid NaOH, then rinsed with warm and finally with cold water, neutralized and dried.

The degree of desizing as measured on the TEGEWA violet scale is rated 1 for the grey-state fabric and 7 for the fabric treated with the assistant according to the invention and obtained as described in Example 1.

If under otherwise identical conditions an anionactive washing agent is used, for example the disodium salt of 1-benzyl-2-heptadecylbenzimidazoledisulphonic acid, in place of the assistant according to the invention, the degree of desizing is rated 5 (on a scale ranging from 1–9).

EXAMPLE 4

A 3000 l capacity jet is charged with 600 l of water (5° of German hardness) and 121 kg of grey-state cotton tricot and heated to 60° C. Thereafter 0.7 ml/l of the textile assistant prepared as described in Example 2 is added, and the tricot is prewetted for 10 minutes, during which no troublesome foam appears. This is followed by the addition in succession of 0.5 ml/l of a peroxide stabilizer, for example a mixture of sodium gluconate, magnesium chloride and a mixture of oligomeric ester condensates of 1-hydroxyethane-1,1-diphosphonic acid, 1.0 ml/l of 45° Bé sodium hydroxide solution and 2.0 ml/l of 35% hydrogen peroxide, and the bath is heated to 90° C. in the course of 30 minutes. At that temperature bleaching is carried out for 45 minutes. This is followed by cooling down and addition to the bath of 3 g/l of a reducing agent, to destroy residual oxygen, in the course of the next 15 minutes. The bath is dropped and the dyebath introduced. The pretreatment produced a good basic white for the subsequent pastel dyeing.

EXAMPLE 5

A 200 g/m$^2$ 65/35 polyester/cotton fabric was bleached on a Steepmaster continuous bleaching range. The material, which had been provided with a mixed size, was desized, rinsed and impregnated wet-on-wet with a bleaching bath of the following composition:

2 ml/l of the textile assistant prepared as described in Example 2, 8 ml/l of a composition of ester condensates of 1-hydroxyethane-1,1-diphosphonic acid, alkali metal glyconate and magnesium chloride, 15 ml/l of 50° Be sodium hydroxide solution, and 36 ml/l of 50% $H_2O_2$.

The material thus impregnated passes in the course of 20 minutes through a hot bleaching bath at 60° C. of the following composition:

2 ml/l of the textile assistant prepared as described in Example 2, 8 ml/l of a composition of ester condensates of 1-hydroxyethane-1,1-diphosphonic acid, alkali metal gluconate and magnesium chloride, 10.5 ml/l of 50% sodium hydroxide solution, and 18.0 ml/l of 50% $H_2O_2$.

After this treatment, which can be carried out without foam developing, the fabric is squeezed off and then steamed with saturated steam for 2 minutes. This is followed by thorough hot and cold rinsing. The material thus treated has a whiteness (filter 46) of 85% as measured using an Elrepho instrument. The DP value of the treated material was 2500, and the Eisenhut damage factor s was 0.1, i.e. undamaged.

EXAMPLE 6

A grey-state, sized cotton fabric of 208 g/m$^2$ is impregnated with a liquor which contains per liter 100 ml of 36° Be sodium hydroxide solution and squeezed off to a liquor pick-up of 60%. This is followed by steaming with saturated steam at 101° C. for 10 minutes and then hot and cold rinsing. Afterwards the fabric is dried and the CIBA-GEIGY whiteness determined, which is found to be −25 (that of the grey-state, untreated fabric was −67). However, if 10 g/l of the textile assistant prepared as described in Example 2 are added to this liquor, the liquor pick-up increases to 95% and the whiteness of the treated fabric is +15.

EXAMPLE 7

A grey-state cotton knit having a weight per unit area of 285 g/m$^2$ is impregnated on a pad-mangle at 25° C. with a liquor which contains per liter 50 g of the dye of the formula

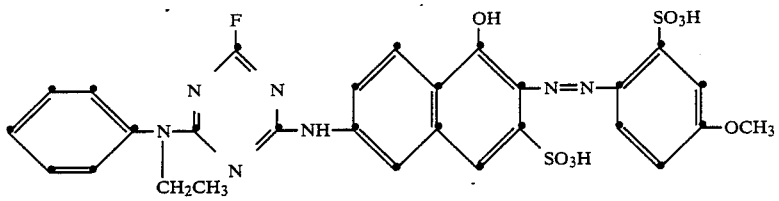

(1)

5 g of the textile assistant prepared as described in Example 2,
15 ml of 30% sodium hydroxide solution and
75 ml of sodium waterglass solution having a silicate content of 26.3–27.7%, whereupon a dip time of 1.0 seconds and a nip pressure of 1.5 bar/cm$^2$ produces in two passes a liquor pick-up of 83% (calculated on the basis of the dry weight of the substrate). The knit is then rolled up and stored at 25° C. for 6 hours. The knit is then rinsed and washed for 20 minutes at the boil with a nonionic detergent (0.5 g/l of the addition product of 9 mol of ethylene oxide on 1 mol of nonylphenol) in a liquor ratio of 40:1. Afterwards the substrate is rinsed once more and dried.

The result obtained is a deep and brilliant red dyeing which is distinguished in particular by a solid appearance.

What we claim is:

1. An aqueous textile assistant of high storage stability and hard water resistance, which comprises, based on the weight of the assistant, (a) 5 to 45% by weight of a partial phosphoric ester consisting essentially of a mixture of 30–38% of phosphoric acid monoester and 62–66% of phosphoric acid diester,
(b) 3 to 27% by weight of a nonionic surfactant,
(c) 0.8 to 7% by weight of an anionic surfactant which is a derivative of an alkylene oxide adduct,
(d) 1.2 to 19% by weight of an alkali metal hydroxide, and
(e) 2 to 90% by weight of deionized water.

2. A textile assistant according to claim 1, wherein component (a) is a partial ester formed from the reaction of 1 mole of $P_2O_5$ with 3 moles of a $C_6$–$C_{10}$-alkanol.

3. A textile assistant according to claim 2, wherein component (a) is present in the form of a salt.

4. A textile assistant according to claim 1, wherein component (b) is a nonionic alkylene oxide addition product of 1 to 100 moles of alkylene oxide on 1 mole of aliphatic monoalcohol having at least 4 carbon atoms.

5. A textile assistant according to claim 4, wherein component (b) is a partially terminally $C_1$–$C_3$-alkyl-blocked addition product of 1 to 100 moles of ethylene oxide and/or propylene oxide on 1 mole of an aliphatic monoalcohol having 8 to 22 carbon atoms.

6. A textile assistant according to claim 1, wherein component (c) is an anionic surfactant of the formula $$R—O—(CH_2CH_2O)_m—X$$

in which R is alkyl or alkenyl having 8 to 22 carbon atoms, alkylphenyl having 4 to 16 carbon atoms in the alkyl moiety or o-phenylphenyl, X is the acid radical of an inorganic oxygen-containing acid or the radical of an organic acid and m is 2 to 30, and the surfactant is present as the free acid, sodium salt or ammonium salt.

7. A textile assistant according to claim 6, wherein component (c) is an anionic surfactant of the formula $$R—O—(CH_2CH_2O)_m—X_1$$

in which R is alkyl or alkenyl having 8 to 22 carbon atoms, $X_1$ is carboxyalkyl having 1 to 3 carbon atoms in the alkyl moiety and m is 2 to 30.

8. A textile assistant according to claim 1, wherein component (a) is a partial ester formed from the reaction of 1 mole of $P_2O_5$ and 3 moles of 2-ethylhexanol, component (b) is a partially terminally methyl-blocked addition product of 5 moles of ethylene oxide and 8 moles of propylene oxide on 1 mole of a $C_9$–$C_{11}$-alkanol, and component (c) is the sodium salt of a terminally carboxymethyl-blocked addition product of 2.5 moles of ethylene oxide on 1 mole of lauryl alcohol.

9. A process according to claim 1, wherein the textile assistant is used in an amount of 0.1 to 20 g per liter of liquor.

10. A process according to claim 9, wherein the fibre material is treated continuously or batchwise in the aqueous liquor.

11. A process for wetting and deaerating fibre materials, which comprises treating the materials in an aqueous liquor in the presence of an aqueous textile assistant comprising, based on the weight of the assistant, (a) 5 to 45% by weight of a partial phosphoric ester consisting essentially of a mixture of 30–38% of phosphoric acid monoester and 62–66% of phosphoric acid diester,
(b) 3 to 37% by weight of a nonionic surfactant,
(c) 0.8 to 7% by weight of an anionic surfactant which is a derivative of an alkylene oxide adduct,
(d) 1.2 to 19% by weight of an alkali metal hydroxide, and
(e) 2 to 90% by weight of deionized water.

12. A process according to claim 9, wherein the textile assistant is used in an amount of 0.5 to 10 g per liter of liquor.

* * * * *